United States Patent [19]

Inada et al.

[11] 4,150,642

[45] Apr. 24, 1979

[54] DIAPHRAGM-OPERATED PRESSURE CONTROL VALVE ASSEMBLY

[75] Inventors: Masami Inada, Toyoake; Kenji Hashimoto; Yukio Suzuki, both of Toyota, all of Japan

[73] Assignees: Aisin Seiki Kabushiki Kaisha, Kariya; Toyota Jidosha Kogyo Kabushiki Kaisha, Toyota, both of Japan

[21] Appl. No.: 816,146

[22] Filed: Jul. 15, 1977

[30] Foreign Application Priority Data

Jul. 19, 1976 [JP] Japan ..... 51-85857

[51] Int. Cl.[2] ..... F07M 25/06

[52] U.S. Cl. ..... 123/119 A; 137/510; 137/544; 137/546

[58] Field of Search ..... 123/119 A; 137/510, 137/859, 544, 546

[56] References Cited

U.S. PATENT DOCUMENTS

| | | | |
|---|---|---|---|
| 3,756,210 | 9/1973 | Kuehl | 123/119 A |
| 3,802,402 | 4/1974 | Swatman | 123/119 A |
| 3,834,366 | 9/1974 | Kingsbury | 123/119 A |
| 3,881,456 | 5/1975 | Nohira et al. | 123/119 A |
| 4,041,917 | 8/1977 | Suzuki | 123/119 A |

*Primary Examiner*—Wendell E. Burns

*Attorney, Agent, or Firm*—Finnegan, Henderson, Farabow & Garrett

[57] ABSTRACT

A pressure control valve assembly comprising a rubber diaphragm to which is applied the negative pressure of the engine intake manifold and the exhaust gas pressure of the engine exhaust manifold. The diaphragm of the present invention is formed with a gradual descent sloping down from a valve-actuating central portion to an outer periphery. Adjacent to one portion of the outer periphery of the diaphragm a port opening to the outside of the valve assembly is provided. Thus, any gas ingredients such as condensed water can be expelled along the descent of the diaphragm via the port without gathering on the diaphragm surface which will therefore be free from objectionable oxidation or corrosion.

9 Claims, 3 Drawing Figures

DIAPHRAGM-OPERATED PRESSURE CONTROL VALVE ASSEMBLY

BACKGROUND OF THE INVENTION

1. Field of the Invention

This invention relates to a diaphragm-operated pressure control valve assembly and, more particularly, to improvements in a pressure control valve assembly of the type used in conjunction with a negative pressure source as well as fluid pressure source and including at least one diaphragm, on one surface of which fluid medium pressure is applied and on the other surface of which negative pressure is applied. The valve assembly of the present invention is, moreover, especially designed for use in systems wherein the fluid medium such as gas contains some ingredients such as condensed water.

2. Description of the Prior Art

A diaphragm-operated valve assembly within which variable control pressure is admitted to effect the valve operation has been conventionally proposed. When the gas containing various ingredients is utilized as the variable control pressure applied onto the rubber diaphragm, any objectionable materials contained in the gas should not gather on the diaphragm in order to prevent the possible oxidation or corrosion thereof due to such materials or ingredients.

One system employing such diaphragm-operated valve assembly is, typically, an exhaust gas recirculation system for the internal combustion engines of automotive vehicles. Exhaust gas recirculation is, as is well known, one of the effective means for reducing the emission of oxides of nitrogen (commonly represented as NOx) by the exhaust systems of internal combustion engines. The exhaust gas is, in the exhaust gas recirculation system, employed as fluid medium for actuating the diaphragm of the valve assembly. However, the conventional diaphragm-operated valve assembly leaves much to be desired because the gas ingredients, such as condensed water, are likely to gather within the valve assembly, particularly on the diaphragm; with the results that the diaphragm is subjected to corrosion or oxidation. U.S. Pat. No. 3,802,402 granted on Apr. 9, 1974 to Mr. Peter Phillimore Swatman or U.S. Pat. No. 3,834,366 granted on Sept. 10, 1974 to General Motors Corporation, for instance, disclose the diaphragm-operated valve assembly, but are silent as to the problems caused by the gas ingredients as mentioned above.

SUMMARY OF THE INVENTION

It is, therefore, one of the objects of the present invention to provide a diaphragm-operated valve assembly which may overcome the drawbacks of the prior art.

It is another object of the present invention to provide a diaphragm-operated valve assembly wherein the form of the diaphragm operable in response to negative pressure as well as fluid pressure is improved so as to gather no fluid ingredients on the diaphragm, thereby avoiding objectionable oxidation or corrosion thereof.

It is a further object of the present invention to provide a diaphragm-operated valve assembly wherein a single diaphragm comprises two partition members to constitute three chambers in order to effect an easy mounting of the diaphragm.

It is still another object of the present invention to provide a diaphragm-operated valve assembly which is particularly designed for use as an exhaust gas recirculation system for internal combustion engines.

According to the diaphragm-operated valve assembly of the present invention, an inner surface of the diaphragm member subjected to fluid medium containing various ingredients includes a gradual descent from an inner periphery associated with a valve member to an outer periphery secured to a valve assembly body. Therefore, the fluid ingredients such as condensed water may be expelled outside via a port provided on the body adjacent to the said outer periphery of the diaphragm member.

DETAILED DESCRIPTION OF THE PREFERRED EMBODIMENTS

Figure 1:
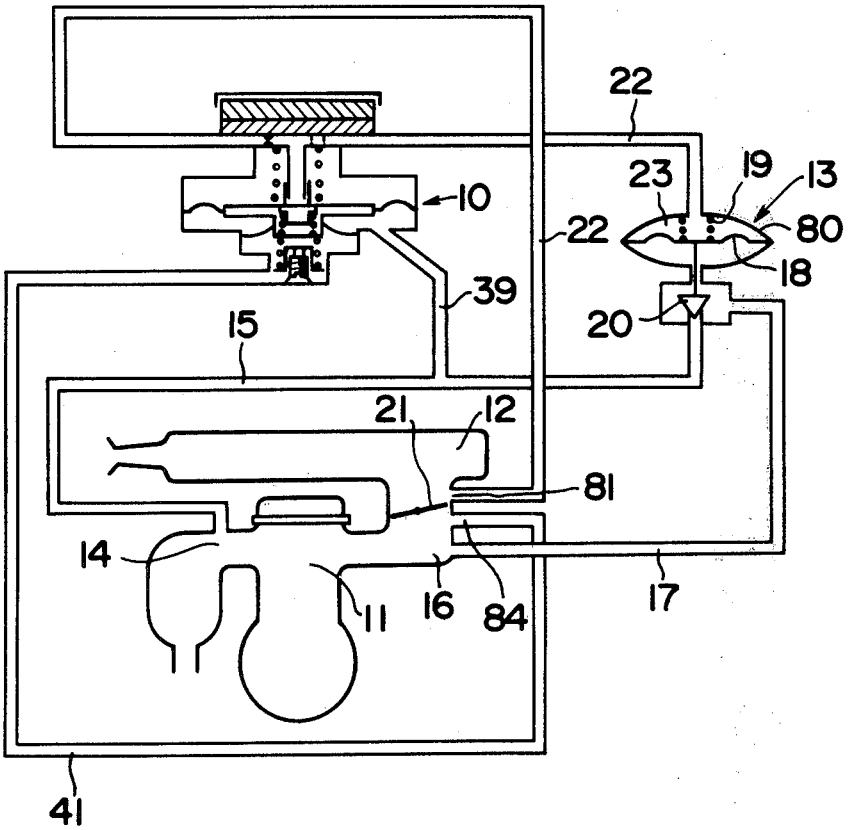
FIG. 1 is a schematic representation of an exhaust gas recirculation system employing a valve assembly of the present invention.

Referring first to FIG. 1 of the drawings, an exhaust gas recirculation system in which a pressure control valve assembly 10 according to the present invention is being employed is schematically shown. The exhaust gas recirculation system further comprises an internal combustion engine 11, a carburetor 12 and a recirculation control valve assembly 13. A recirculation conduit 15 in open communication with an exhaust manifold 14 may be, through means of the valve assembly 13, connected to a recirculation conduit 17 in open communication with an intake manifold 16. The valve assembly 13 determines when exhaust gas recirculation is to take place as will be hereinafter explained, and includes a casing 80, a diaphragm 18 for partitioning the interior of casing 80, and a valve piston 20 associated with the diaphragm 18 and biased downwards by means of a spring 19 to interrupt pneumatic communication between the recirculation conduits 15 and 17. The valve piston 20 of valve assembly 13 will be moved up in accordance with the negative pressure within a chamber 23 which is through a negative pressure conduit 22 in communication with a negative pressure outlet port 81 controllable by a throttle valve 21 of carburetor 12.

Figure 2:
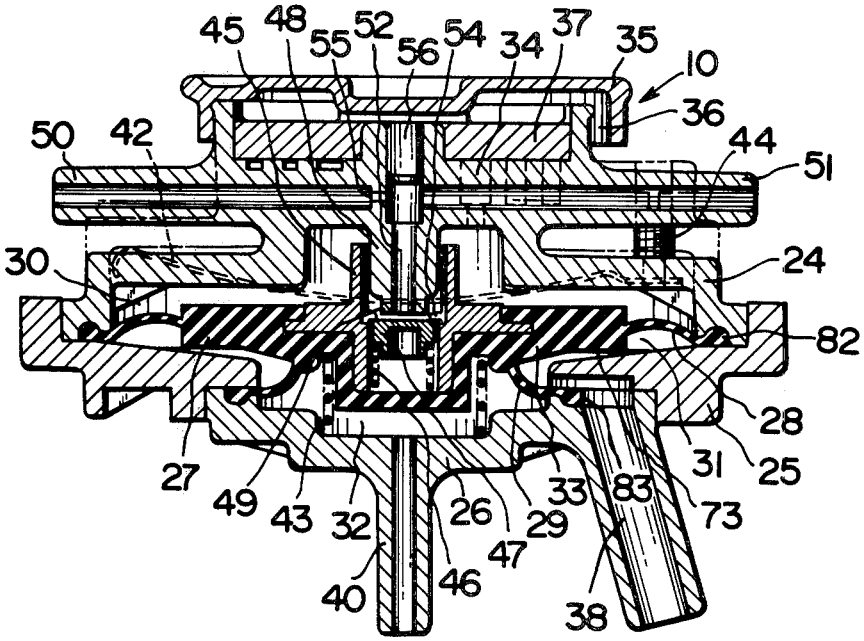
FIG. 2 is an enlarged sectional view of one embodiment of the valve assembly used in the exhaust gas recirculation system.

The pressure control valve assembly 10 of the present invention is disposed within the negative pressure conduit 22. A first embodiment of the pressure control valve assembly 10 as shown in FIG. 2 includes a first body 24, a second body 25 secured to the first body 24, and a third body 26 secured to the second body 25.

A single diaphragm 27 disposed within the interior constituted by the bodies 24, 25 and 26 is provided with an upper partition member 28, an outer periphery 82 which is fixedly held between the first and the second bodies 24 and 25, a lower partition member 29, and an outer periphery 83 which is fixedly held between the second and the third bodies 25 and 26. Consequently, the interior of the valve assembly 10 is divided into three chambers: an atmospheric air chamber 30, an exhaust gas chamber 31 and a negative pressure chamber 32. The function of each chamber in the exhaust gas recirculation system will be described in more detail below.

Each of the upper and the lower partition members 28 and 29 of diaphragm 27 is at the surface confronting the exhaust gas chamber 31 formed with a gentle curve, i.e., the shape of the inner surface of each partition member is an almost circular arc between the outer periphery thereof and the integral main boss 33 of a larger thickness of diaphragm 27. It is to be particularly noted that the lower partition member 29 is formed with the gentle descent shape in which the main boss 33 is the highest portion while the outer periphery 83 thereof is the lowest portion as illustrated, thereby forming no portion which is lower than the outer periphery 83. As a result, any objectionable material contained within the exhaust gas such as condensed water will flow out along the curved partition member 29 descending from the main boss 33 to the outer periphery 83 so as not to be gathered in the exhaust gas chamber 31. It should be recognized that the gently spherical or circular shape of the lower partition member 29 at the inner surface thereof is not essential in the present invention but the lower partition member 29 of diaphragm 27 may be formed with a straight line descending from the main boss 33 to the outer periphery 83 thereof in order to prevent the gathering of condensed water or other exhaust gas ingredients thereon.

The atmospheric air chamber 30 is in the permanent communication with the atmospheric air by way of a hole 34 formed through the first body 24 and a gap 36 formed between the first body 24 and a cover cap 35 secured thereto. Foreign materials contained in the atmospheric air admitted to the chamber 30 may be excluded by means of air filter 37 interposed between the cover cap 35 and the first body 24.

The exhaust gas chamber 31 is connected at an inlet 38 thereof to a branch conduit 39 of the recirculation conduit 15, thereby being admitted with the exhaust gas pressure which essentially corresponds to the engine rotation. The negative pressure chamber 32 is connected at an inlet 40 thereof to a conduit 41 which is in turn connected to a negative pressure outlet port 84 of intake manifold 16.

The single diaphragm 27 is urged to move down due to the force exerted by a leaf spring 42 mounted on the first body 25 while pressure to move up is provided by a helical spring 43. That is to say, the diaphragm 27 is moved downwards by the leaf spring 42 and the negative pressure in the negative pressure chamber 32, and moved upwards by the helical spring 43 and the gas pressure in the exhaust gas pressure 31. The outer periphery of the leaf spring 42 is secured to the first body 24 through means of a screw 44 while the inner periphery thereof imparting the downward urging force is engaged with a metal boss 45 made integrally with the diaphragm boss 33. It will be seen that the axial movement of the screw 44 adjusts the urging force of leaf spring 42 onto the diaphragm 27.

A movable valve member 47 disposed within the boss 45 is urged to move up by a coiled spring 46 so as to engage a valve seat 49 which is formed at the edge of an axial extension 48 of the first body 24. Thus, the communication between the atmospheric air chamber 30 and a passage 52 in the first body 24, formed between an inlet port 50 of the first body 24 and an outlet port 51 thereof and connected to the negative pressure conduit 22, may be controlled. More specifically, the valve member 47 engages a shoulder or flange 54 of diaphragm metal boss 45 during the inoperative condition in which the diaphragm 27 is being brought to engagement with a stopper 73 mounted on the second body 25 as seen in FIG. 2. Therefore, the valve member 47 is released from the valve seat 49 so that the passage 52 is connected to the atmospheric chamber 30 via clearance between the first body 24 and the diaphragm metal boss 45. Between the inlet port 50 and the outlet port 51 of passage 52, is provided an orifice 55 for restricting the admission of atmospheric air to the inlet port 51 when the valve member 47 is open, thereby ensuring the atmospheric air pressure at the outlet port 51. A plug 56 is fitted in the axial hole of the first body 24 to constitute the T-shaped passage 52.

In operation, the pressure control valve assembly 10 is actuated in accordance with the exhaust gas pressure which is substantially proportional to the engine rotational number and the intake manifold pressure which is responsive to the operational load condition of the engine. The diaphragm 27 is moved down due to the negative pressure in the negative pressure chamber 32 against the spring 43 and the exhaust gas pressure when the vehicle engine is in a small load operation such as during idling or during deceleration. Therefore, the valve member 47 is released from the valve seat 49. In small load operating conditions such as above, the negative pressure conduit 22 is in communication with the atmospheric air via passage 52 and outlet port 51, to maintain the valve piston 20 at the closed position. The intake manifold negative pressure prevailing in the negative pressure chamber 32 is low when the vehicle engine is in full load operation such as during running at high speed or during the climbing slopes. In such full load operations, while the exhaust gas pressure in the exhaust gas chamber 31 is lower than the urging force of leaf spring 42 the valve member 47 is released from the valve seat 49 to bleed the atmospheric air in the conduit 22. When the exhaust gas pressure is increased, due to the increase in engine rotation, to overcome the urging force of leaf spring 42 the diaphragm 27 is moved up to seat the valve member 47 on the valve seat 49. Therefore, no air is bled to the negative pressure conduit 22. However, it is to be understood that the advance port pressure of the carburetor 12 is small enough to keep the valve piston 20 of assembly 13 in the closed position by the spring 19. As will be apparent from the foregoing description, when the vehicle engine is in the small or full load operation, no exhaust gas recirculation may be achieved irrespective of the exhaust gas pressure.

When the engine is in average load condition such as when running at constant speed, the negative pressure generated at the advance port 81 and admitted to the chamber 23 of valve assembly 13 through the negative pressure conduit 22 will prevail to open the valve piston 20. The intake manifold pressure admitted to the negative pressure chamber 32 of the control valve assembly 10 is relatively low although higher than in the full load condition of the engine. As a result the exhaust gas recirculation is effected in accordance with the intake manifold pressure and the exhaust gas pressure. More specifically, when the exhaust gas pressure overcomes the negative pressure in the chamber 32 and the influence of leaf spring 42, the valve member 47 as well as the diaphragm 27 is lifted to engage the valve seat 49. The negative pressure conduit 22 is thus isolated from the atmospheric chamber 30 and the negative pressure at the advance port 81 causes the valve pistion 20 of assembly 13 to move up, thereby effecting the recirculation.

However, when the exhaust gas pressure is decreased due to the decrease of engine rotation, the diaphragm 27 is moved down by means of the intake manifold pressure in the negative pressure chamber 32 and the force of the leaf spring 42. The valve member 47 is thus released from the seat 49 to bleed the atmospheric air into the negative pressure conduit 22, thereby closing the valve piston 20 of the assembly 13; with the result that exhaust gas recirculation is precluded.

Figure 3:
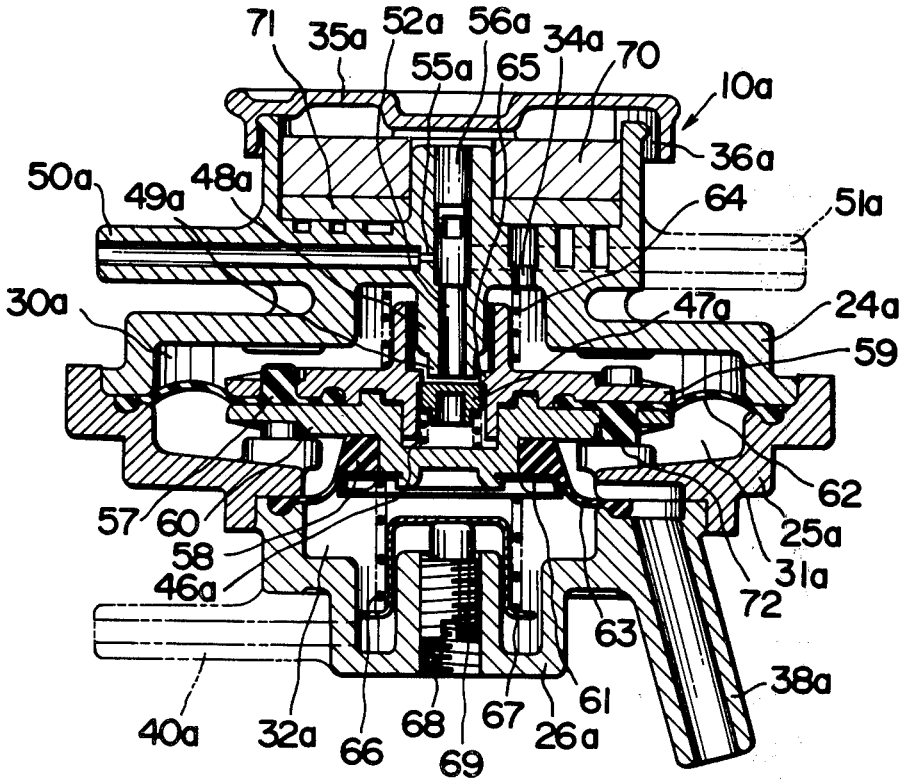
FIG. 3 is a view similar to FIG. 2 but showing another embodiment of the valve assembly.

Referring now to FIG. 3, a modified embodiment of the invention wherein those components which are constructed and arranged in the same manner as in FIG. 2 are identified by the same reference numerals with the affix "a", is shown.

According to the pressure control valve assembly **10*a* depicted in FIG. 3, a first or upper diaphragm 57 and a second or lower diaphragm 58 are provided separate from each other in order to constitute an atmospheric air chamber 30*a*, an exhaust gas pressure chamber 31*a* and a negative pressure chamber 32*a*. The upper diaphragm 57 is at the outer periphery thereof secured by a first body 24*a* and a second body 25*a* while at the inner periphery thereof is secured by a first movable member 59 and a second movable member 60, the said first and second members being fixed to each other. Similarly, the lower diaphragm 58 is at the outer periphery thereof secured by the second body 25*a* and a third body 26*a* while at the inner periphery thereof is secured by the second movable member 60 and a support member 61 fixed thereto. An underside 72 of the upper diaphragm 57 is in contact with the second body 25*a* while recirculation is not necessary. It should be recognized that each inner surface 62, 63 of the first and the second diaphragms 57, 58 is formed substantially in the same manner as in FIG. 1**.

The first movable member 59 is urged to move down by the exerting force of spring 64 disposed in the atmospheric air chamber **30*a* while no recirculation is to take place. Therefore, a valve member 47*a* is released from a valve seat 49*a* due to engagement with a shoulder 65 of the first movable member 59. Between the support member 61 and a spring retainer 67 in the negative pressure chamber 32*a* a helical spring 66 is interposed which will function in the same manner as the spring 43 of FIG. 1**.

A screw-threaded bolt 69 is fitted in the third body **26*a* together with a silicone seal 68. The axial movement of the bolt 69 adjusts the exerting force of spring 66. Relatively coarse foreign materials contained in the atmospheric air may be filtered by an upper filter 70, whilst relatively fine foreign materials may be filtered by a lower filter 71 arranged in series to the upper filter 70**.

The operation of the valve assembly **10*a* is substantially the same as that of the valve assembly 10** and will be readily understood to those skilled in this art, so that the detailed description thereof may be omitted.

What we claim is:

1. A pressure control valve assembly for use in conjunction with a first negative signal pressure source, a second positive signal pressure source, and an uncontrolled atmospheric fluid line, comprising:

a. a body having port means in fluid flow communication to the outside thereof;

b. diaphragm means including a central portion and upper and lower partition members radially extending therefrom for dividing the interior of said body into first, second and third chambers, said chambers being in fluid-flow communication with said first signal pressure source, said second signal pressure source, and said uncontrolled fluid line, respectively, said diaphragm means being movable upward in response to an increase in said first signal fluid pressure and downward in response to a decrease in said second signal pressure;

c. said partition members having outer peripheries connected to the walls of said body and so defining therebetween said second chamber, the outer periphery of said lower partition member being the lowest point of said lower partition member providing the bottom surface of said second chamber with a sloping gradient radially descending from said central portion of said diaphragm means for preventing collection of liquid or particulate ingredients contained in the signal fluid from said second signal fluid pressure source and permitting drainage of these ingredients through said port means;

d. A valve member operatively associated with the movement of said diaphragm means to control said uncontrolled fluid line; and e. first adjustable biasing means for urging said diaphragm means downward and second biasing means for urging said diaphragm means upward.

2. A valve assembly as set forth in claim 1 wherein the sloping gradient of the lower partition member forms substantially a circular arc.

3. A valve assembly as set forth in claim 1 wherein the sloping gradient of said lower partition member forms substantially a straight line.

4. A valve assembly as set forth in claim 1 wherein the sloping gradient of said lower partition member comprises substantially a horizontal portion and a gradual descent portion starting from said horizontal portion.

5. The valve assembly as set forth in claim 1 wherein said first signal source is the negative pressure created in an internal combustion engine, wherein said second signal pressure source is the positive pressure of the exhaust gas of an internal combustion engine and wherein said uncontrolled fluid line is open to atmospheric pressure.

6. In a pressure control valve assembly for use in an exhaust gas recirculation system responsive to engine developed vacuum and engine exhaust gas pressure and having an access line to atmospheric pressure including a hollow body having port means in fluid flow communication with said vacuum, said exhaust gas pressure and atmospheric pressure, a diaphragm means movably secured within the body having a central portion and radially extending upper and lower partition members the outer peripheries of which being secured to the walls of said body for dividing the body into first, second and third chambers, said first chamber in communication with said vacuum, said second chamber being between said upper and lower partition members and in communication with said exhaust gas pressure and said third chamber in communication with said atmospheric pressure, first adjustable biasing means for urging said diaphragm means downward and second biasing means for urging said diaphragm means upward, and a valve member operatively associated with the movement of said diaphragm means and responsive to said vacuum, said exhaust gas pressure and said first and second biasing means to control said atmospheric pressure line, the improvement comprising:

said lower partition member having a radially descending slope from said central portion, the periphery of said lower partition member being secured to the walls of said body at a lever lower than any other point on said lower partition member for preventing the collection of liquid or particulate ingredients on said lower partition member and permitting expulsion of said ingredients through said port means in communication with said second chamber.

7. The valve assembly as in claim 6 wherein said slope of the lower partition member is a substantially circular arc.

8. The valve assembly as in claim 6 wherein said slope of the lower lower partition member is a substantially straight line.

9. The valve assembly as in claim 6 wherein said slope of the lower partition member is divided into a substantially horizontal portion and a sloping portion descending from the horizontal portion to the periphery of said lower partition member.

* * * * *

UNITED STATES PATENT AND TRADEMARK OFFICE

CERTIFICATE OF CORRECTION

PATENT NO. : 4,150,642

DATED : April 24, 1979

INVENTOR(S) : Masami Inada et al

It is certified that error appears in the above-identified patent and that said Letters Patent are hereby corrected as shown below:

Column 7, claim 6, line 5, change "lever" to --level--.

Signed and Sealed this

*Seventeenth* Day of *July 1979*

[SEAL]

*Attest:*

*Attesting Officer*

LUTRELLE F. PARKER

*Acting Commissioner of Patents and Trademarks*